US006872175B2

(12) United States Patent
Lin

(10) Patent No.: US 6,872,175 B2
(45) Date of Patent: Mar. 29, 2005

(54) EXERCISE BALANCE TRAINER

(75) Inventor: William Lin, Taichung (TW)

(73) Assignee: Asia Regent Limited (TW)

( * ) Notice: Subject to any disclaimer, the term of this patent is extended or adjusted under 35 U.S.C. 154(b) by 47 days.

(21) Appl. No.: 10/286,629

(22) Filed: Oct. 31, 2002

(65) Prior Publication Data

US 2004/0087421 A1 May 6, 2004

(51) Int. Cl.[7] ..... A63B 22/14; A63B 22/16

(52) U.S. Cl. ..... 482/146; 482/34; 482/77; 482/146; 482/121

(58) Field of Search ..... 482/34, 77, 80, 482/146–147, 121–130, 148

(56) References Cited

U.S. PATENT DOCUMENTS 3,604,726 A * 9/1971 Tracy ..... 280/205
3,716,229 A * 2/1973 Van Der Cleyen et al. ... 482/77
5,765,921 A * 6/1998 Chuang ..... 297/423.46
6,461,285 B1 * 10/2002 Theunissen et al. ..... 482/146

* cited by examiner

*Primary Examiner*—Danton D. DeMille
*Assistant Examiner*—L Amerson
(74) *Attorney, Agent, or Firm*—DLA Piper Rudnick Gray Cary US LLP

(57) ABSTRACT

An exercise balance trainer includes a hard board and a resilient ball body connected to the board. The ball body has a first curved wall with a first rim, a second curved wall with a second rim connected fixedly to the first rim so as to define an air-receiving chamber between the first and second curved walls, and an annular flange connected to the board and a junction of the first and second rims. The first and second rims have the same diameter. The first curved wall has a maximum height that is not greater than one-half of the diameter of the first rim. The second curved wall has a maximum height that is not greater than one-third of the diameter of the second rim.

9 Claims, 18 Drawing Sheets

EXERCISE BALANCE TRAINER

BACKGROUND OF THE INVENTION

1. Field of the Invention

The invention relates to an exerciser, more particularly to an exercise balance trainer.

2. Description of the Related Art

Referring to FIG. 1, an existing inflatable exercise ball 1 is shown to have a resiliency such that when a user's back portion reclines on the exercise ball 1, training of the stomach, spine and back muscles can be attained.

Referring to FIG. 2, another existing exerciser 2 is shown to include a base 201 mounted on a ground surface, and an inflatable semi-spherical ball body 202 connected to the base 201. In use, the user's back portion reclines on the ball body 202 so as to train the stomach muscle. Alternatively, the user can stand on the ball body 202 using only one foot to proceed with balance training exercise.

Although the above-mentioned exercisers 1, 2 can achieve their intended purposes, the operations of the exercisers 1, 2 are monotonous such that the functionality of the exercisers 1, 2 and the effect of the exercises are limited.

SUMMARY OF THE INVENTION

Therefore, the main object of the present invention is to provide an exercise balance trainer that permits multiple exercises and balance training.

According to the present invention, an exercise balance trainer comprises a hard board and a resilient ball body. The hard board has a planar first surface, a planar second surface opposite to the first surface, and a central opening extending through the hard board. The resilient ball body is connected to the hard board, and has a first curved wall, a second curved wall, and an annular flange. The first curved wall has a first rim. The second curved wall has a second rim connected fixedly to the first rim so as to define an air-receiving chamber between the first and second curved walls. The flange is connected to the board and a junction of the first and second rims. The first curved wall projects from the first surface of the board, whereas the second curved wall projects from the second surface of the board. The first and second rims have the same diameter. The first curved wall has a maximum height that is not greater than one-half of the diameter of the first rim. The second curved wall has a maximum height that is not greater than one-third of the diameter of the second rim.

BRIEF DESCRIPTION OF THE DRAWINGS

Other features and advantages of the present invention will become apparent in the following detailed description of the preferred embodiments with reference to the accompanying drawings, of which.

DETAILED DESCRIPTION OF THE PREFERRED EMBODIMENTS

Figure 1:
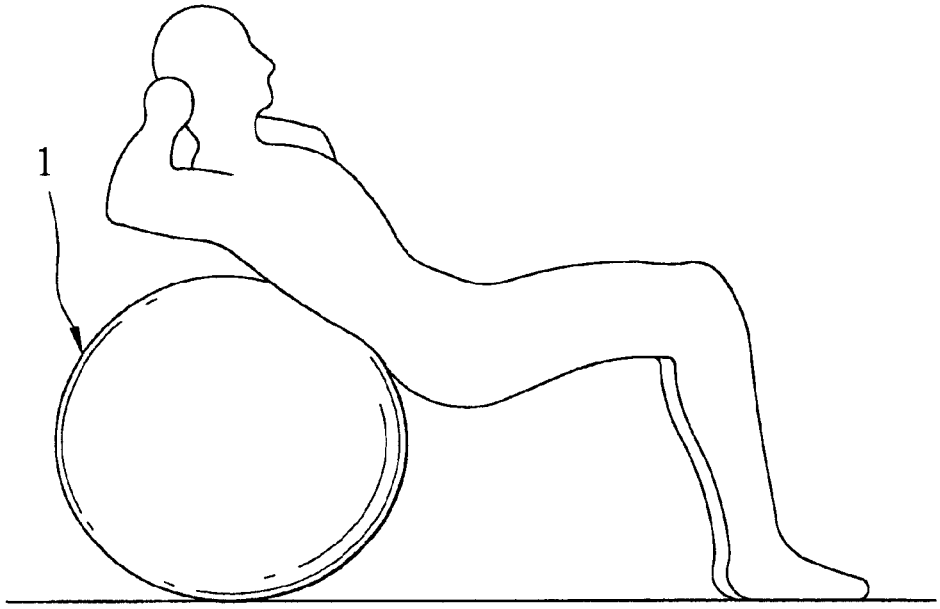
FIG. 1 PRIOR ART
FIG. 1 illustrates an existing inflatable exercise ball in a state of use.
Figure 2:
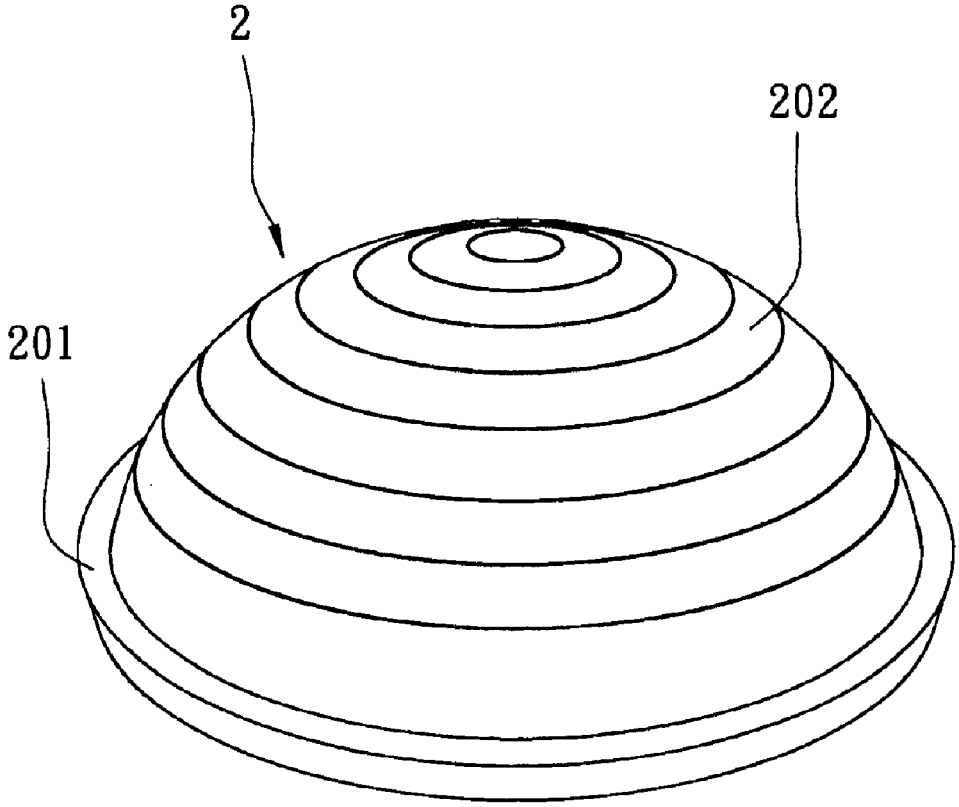
FIG. 2 PRIOR ART
FIG. 2 is a perspective view of another existing exerciser.

Before the present invention is described in greater detail, it should be noted that like elements are denoted by the same reference numerals throughout the disclosure.

Figure 3:
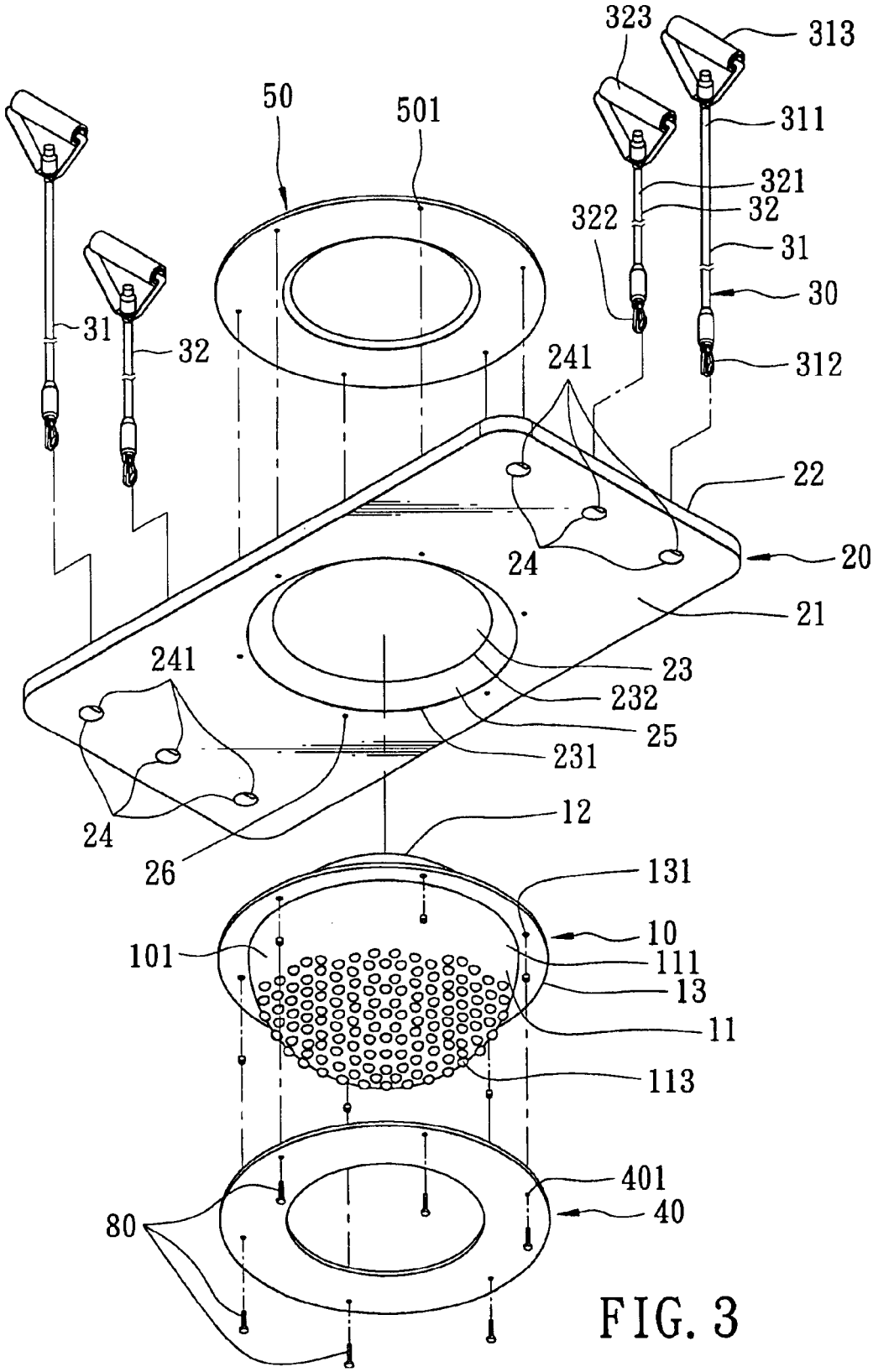
FIG. 3 is a partly exploded perspective view of the first preferred embodiment of an exercise balance trainer according to the present invention.
Figure 4:
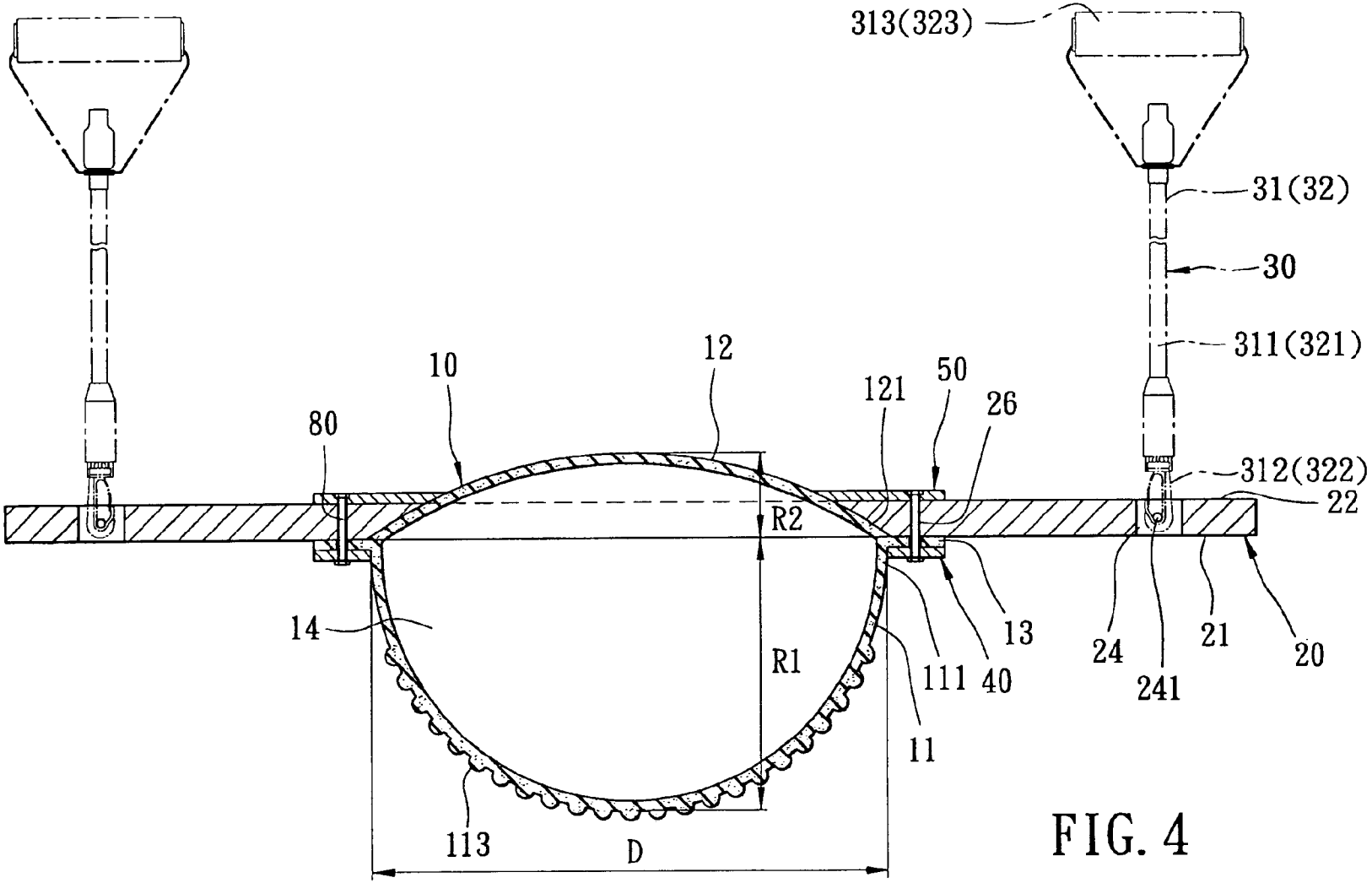
FIG. 4 is a sectional view of the preferred embodiment in an assembled state.

Referring to FIGS. 3 and 4, the first preferred embodiment of an exercise balance trainer according to the present invention is shown to comprise an elongated hard board 20, a resilient ball body 10, an annular first clamping plate 40, an annular second clamping plate 50, and an auxiliary holding unit 30.

The hard board 20 has a planar first surface 21, a planar second surface 22 opposite to the first surface 21, a central opening 23 extending through the board 20, an annular edge face 25 that confines the opening 23 and that is tapered, and a plurality of spaced-apart screw holes 26 that surround the opening 23. The opening 23 has a first end 231 in the first surface 21 of the board 20, a second end 232 in the second surface 22 of the board 20, and a diameter that increases from the second end 232 to the first end 231. The hard board 20 further has two ends, each of which is formed with three spaced-apart through holes 24. Each of the through holes 24 in the hard board 20 is provided with a positioning rail 241 disposed fixedly therein.

The resilient ball body 10 is hollow, is formed by molding a plastic material, and can be inflated with air or filled with water. The ball body 10 is connected to the hard board 20, and has a first curved wall 11, a second curved wall 12, and an annular flange 13. The first curved wall 11 has a first rim 111 and an outer surface 101 formed with a plurality of rounded projections 113 to perform a massaging function, and projects from the first surface 21 of the board 20. The second curved wall 12 has a second rim 121 (see FIG. 4) connected fixedly to the first rim 111 so as to define an air-receiving chamber 14 (see FIG. 4) between the first and second curved walls 11, 12. The second curved wall 12 projects from the second surface 22 of the board 20, and abuts against the edge face 25 of the board 20 in such a manner that the board 20 is sleeved on the second curved wall 12. The first and second rims 111, 121 have the same diameter (D). The first curved wall 11 has a maximum height (R1) that is not greater, i.e., equal to or smaller than one-half of the diameter (D) of the first rim 111. The second curved wall 12 has a maximum height (R2) that is not greater, i.e., equal to or smaller than one-third of the diameter (D) of the second rim 121. The flange 13 is connected fixedly to the board 20 and a junction of the first and second rims 111, 121, and has a plurality of spaced-apart positioning holes 131 formed therethrough.

The first clamping plate 40 is sleeved on the first curved wall 11, and has a plurality of spaced-apart screw holes 401. The second clamping plate 50 is sleeved on the second curved wall 12, and has a plurality of spaced-apart screw holes 501. A plurality of screws 80 extend through the respective screw holes 401 in the first clamping plate 40, the respective positioning holes 131 in the flange 13, and the respective screw holes 26 in the hard board 20, and engage the respective screw holes 501 in the second clamping plate 50 so as to clamp the board 20 and the flange 13 between the first and second clamping plates 40, 50, thereby positioning the hard board 20 on the ball body 10.

The auxiliary holding unit 30 is connected detachably to the hard board 20, and includes two long holding members 31, and two short holding members 32 that are shorter than the long holding members 31. The long and short holding members 31, 32 are flexible, and are fastened detachably to the board 20. Each of the long and short holding members 31, 32 has a rope body 311, 321 that includes a holding end provided with a handgrip 313, 323, and a connecting end provided with a snap fastener 312, 322 that is sleeved on a respective one of the positioning rails 241 in the through holes 24 of the hard board 20 so as to retain the long and short holding members 31, 32 on the hard board 20.

When the exercise balance trainer of this present invention is disposed at the position shown in FIG. 4, where the first surface 21 and the first curved wall 11 are located under the second surface 22 and the second curved wall 12, it is suitable for beginners.

Furthermore, the position of the exercise balance trainer of the present invention can be reversed such that the first surface 21 and the first curved wall 11 are disposed above the second surface 22 and the second curved wall 12, respectively, so as to conform to the desired exercise function. The long and short holding members 31, 32 can be fastened to the hard board 20, if necessary.

Figure 5:
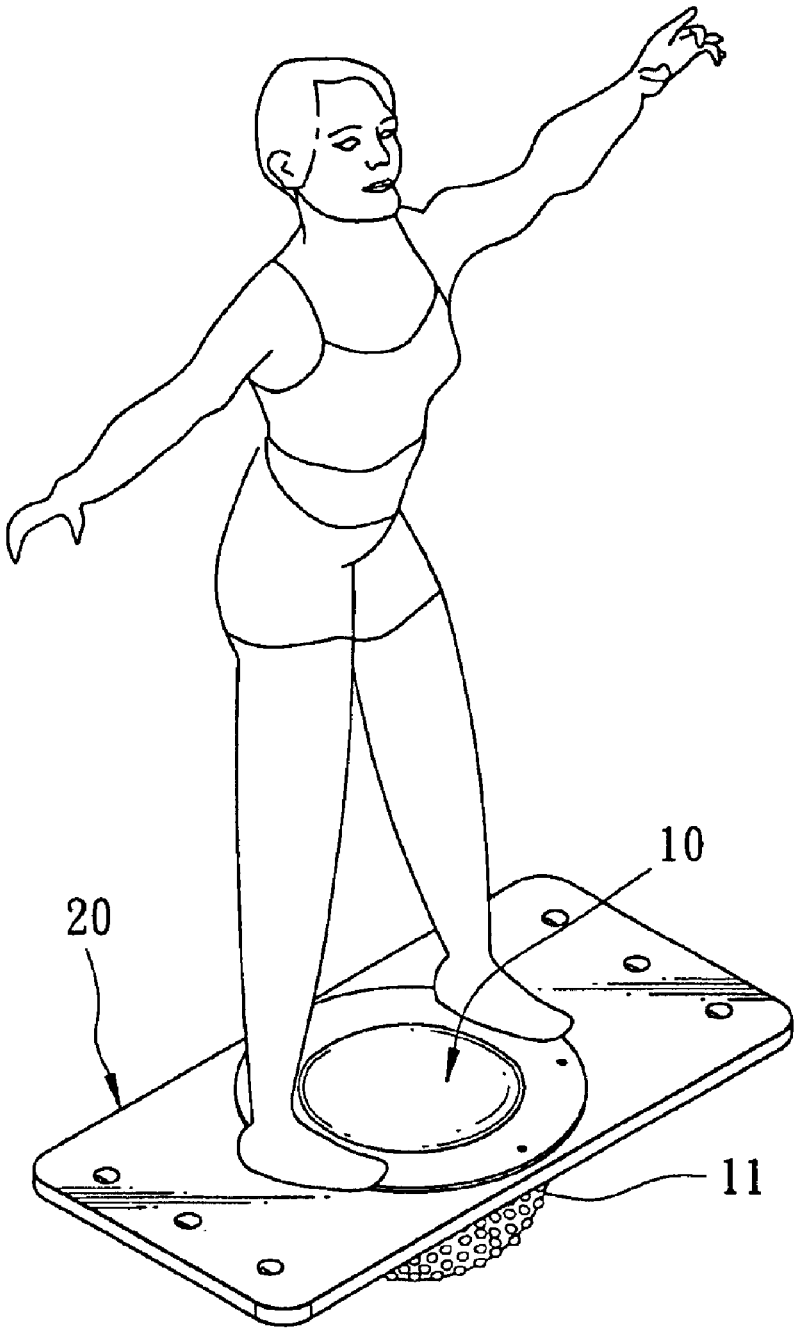
FIGS. 5 to 16 illustrate a series of exercises that can be performed using the first preferred embodiment.

Thus, the following exercises can be performed using the first preferred embodiment of the present invention:

1. Referring to FIG. 5, the first curved wall 11 of the ball body 10 is positioned below the hard board 20, and is in contact with a ground surface. When the user's feet are positioned on the hard board 10 at two sides of the ball body 10, the user has to use his feet to stably support himself so as not to fall off from the board 20 and so as to balance different parts of his body. As such, training of the waist, stomach, and thigh muscles can be achieved. Moreover, the user can proceed with left and right stepping exercises relative to the board 20 to attain balance training.

Figure 6:
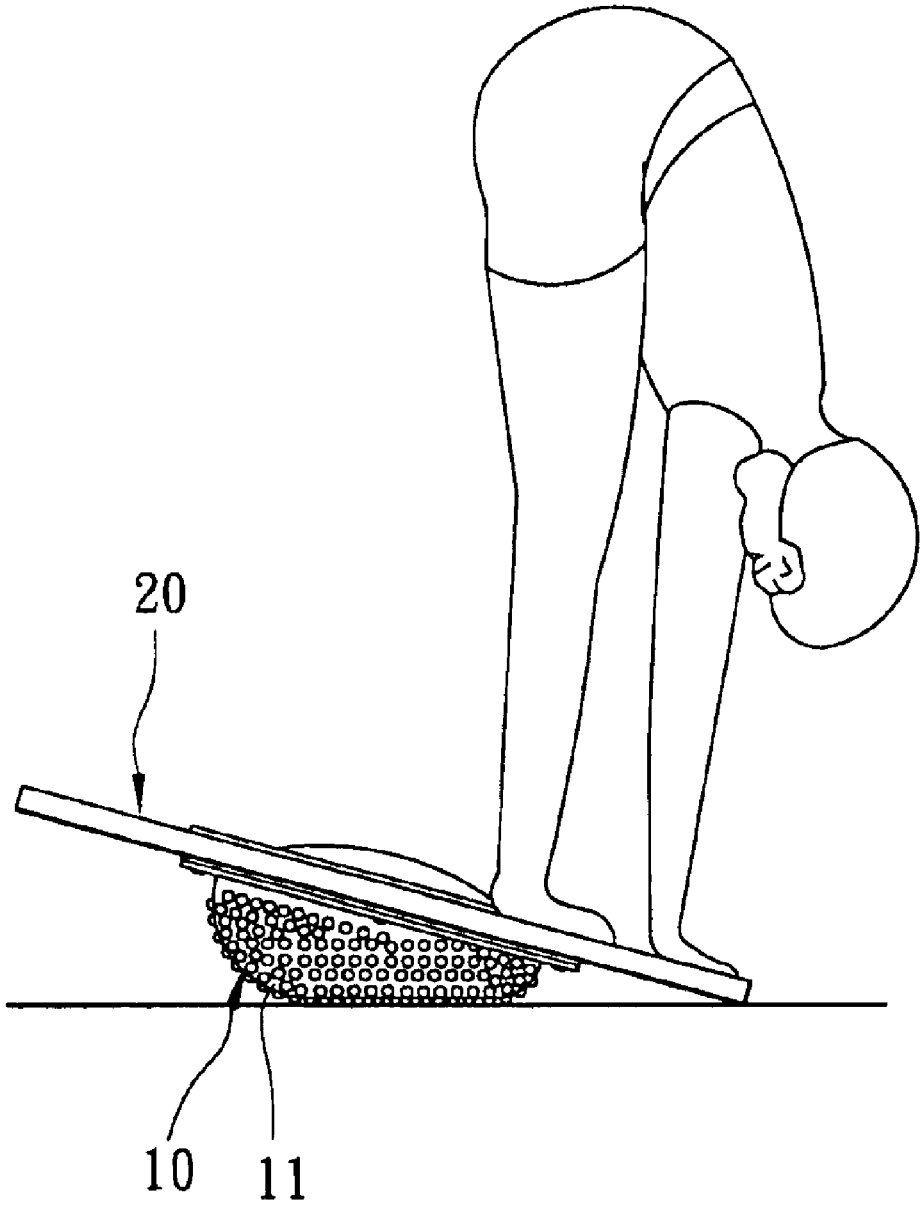

2. Referring to FIG. 6, the user's feet are positioned on the hard board 20 at one side of the ball body 10 to perform a bending exercise so as to proceed with stretching and soft exercises.

Figure 7:
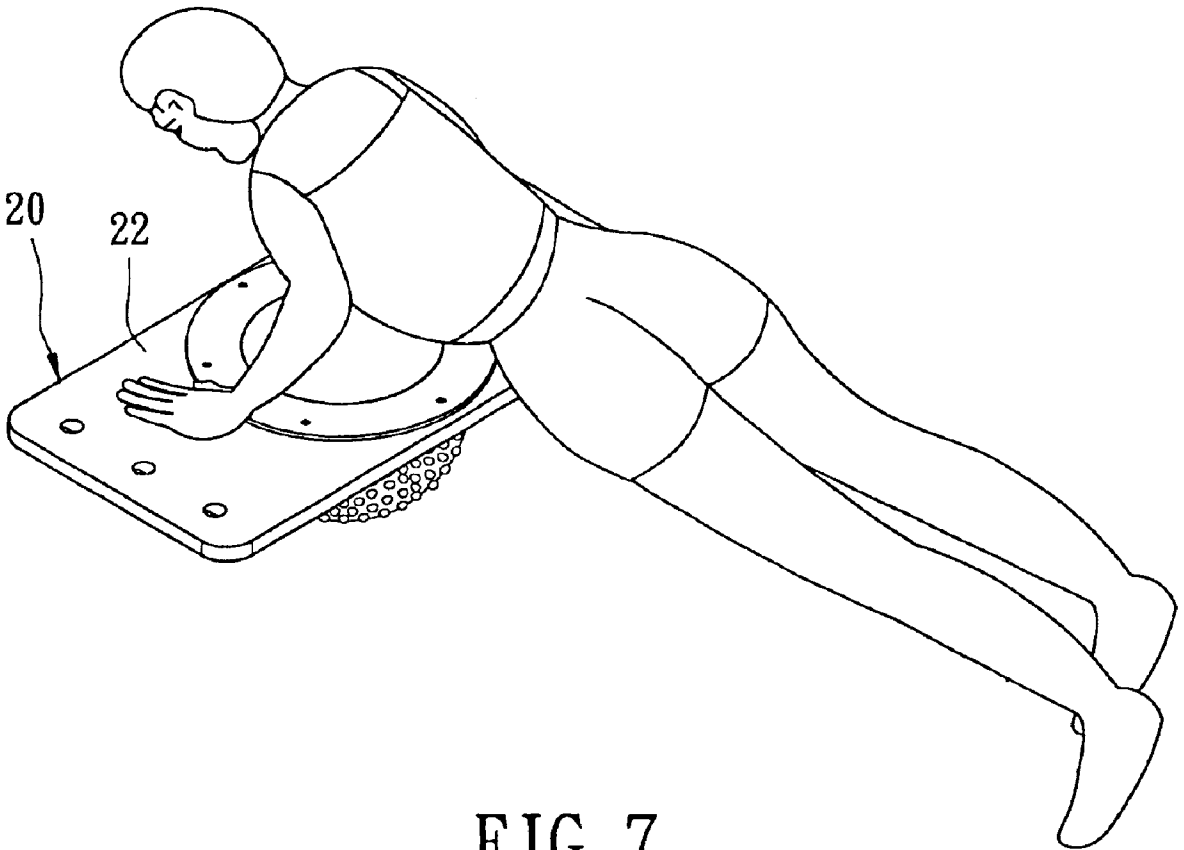

3. Referring to FIG. 7, when the user has his hands pressing downwardly against the second surface 22 of the hard board 20 and his toes in contact with the ground, he can proceed with a push-up exercise that promotes body training.

Figure 8:
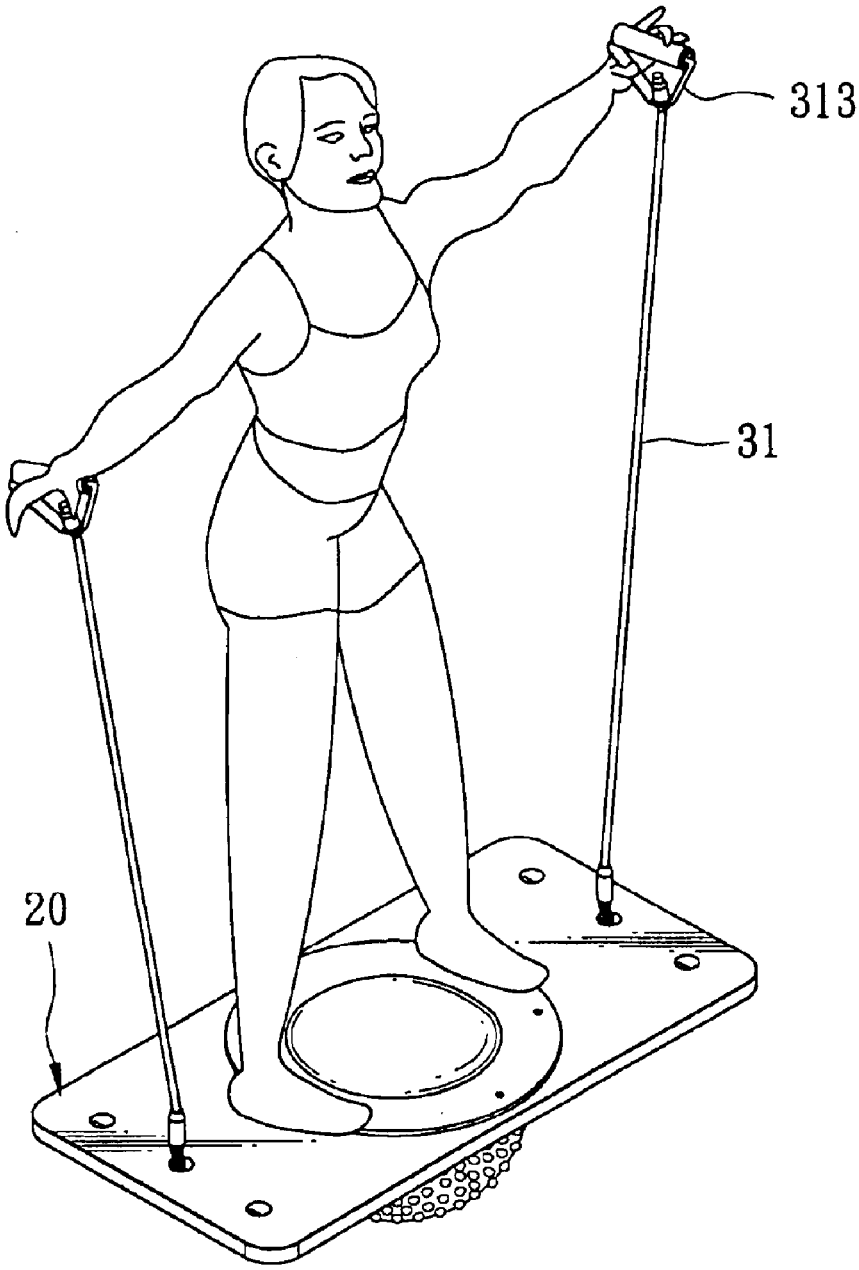

4. Referring to FIG. 8, the long holding members 31 are initially fastened to two ends of the hard board 20. Then, the user stands on the board 20 with both hands grasping the respective handgrips 313 of the long holding members 31 to proceed with waist twisting exercise and balance training.

Figure 9:
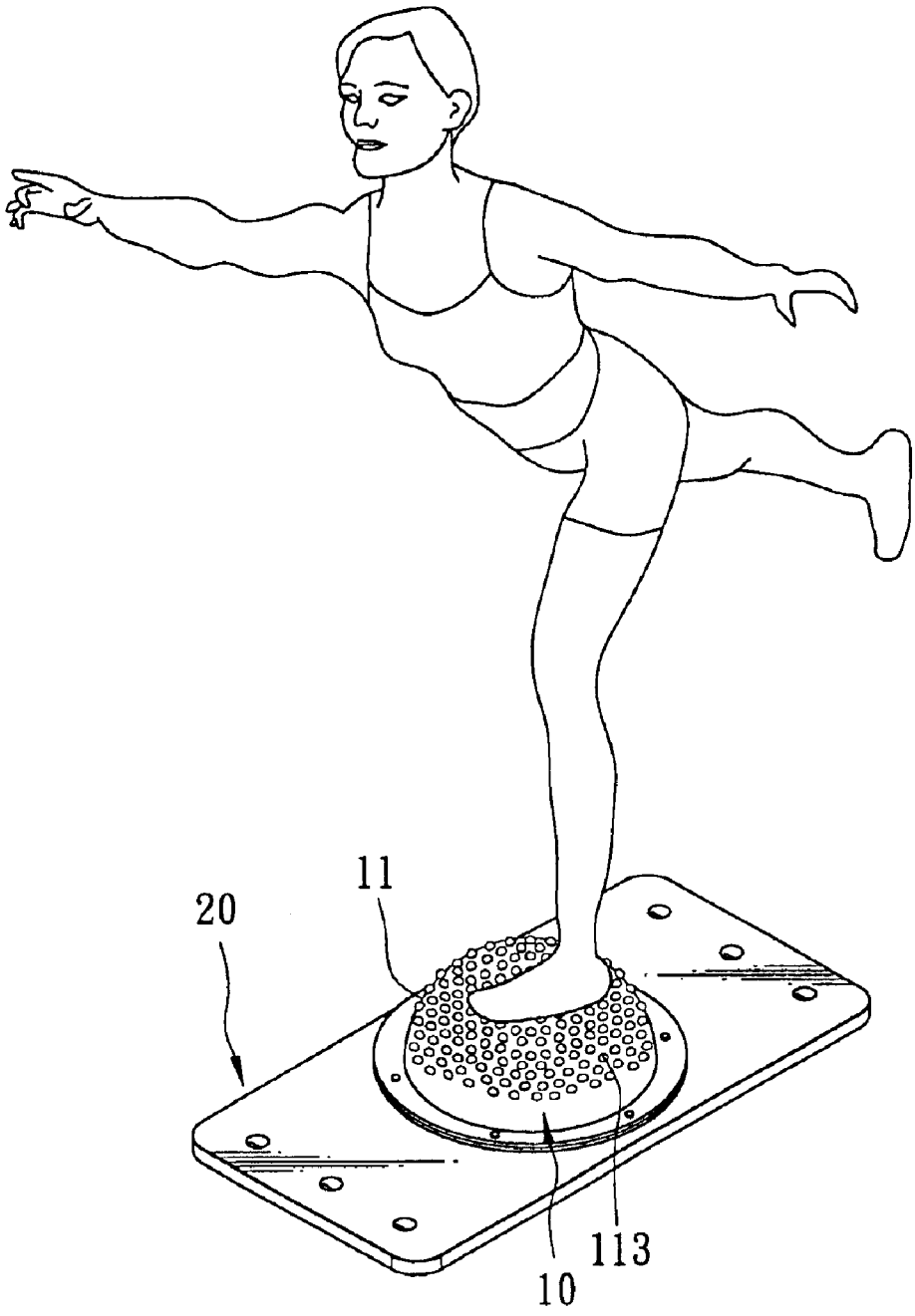

5. Referring to FIG. 9, the exercise balance trainer of the present invention is upturned so that the first curved wall 11 of the ball body 10 is positioned above the hard board 20. In this exercise, the holding members 31, 32 (see FIG. 8) are not required, and the user has to stand on the first curved wall 11 using one foot. The single foot has to support the user stably so as not to allow the user to fall off from the ball body 10, and has to balance different parts of the user's body, thereby effecting single foot balance training and body training. At the same time, massaging of the foot is attained and slipping is prevented due to the presence of the rounded projections 113 on the first curved wall 11.

Figure 10:
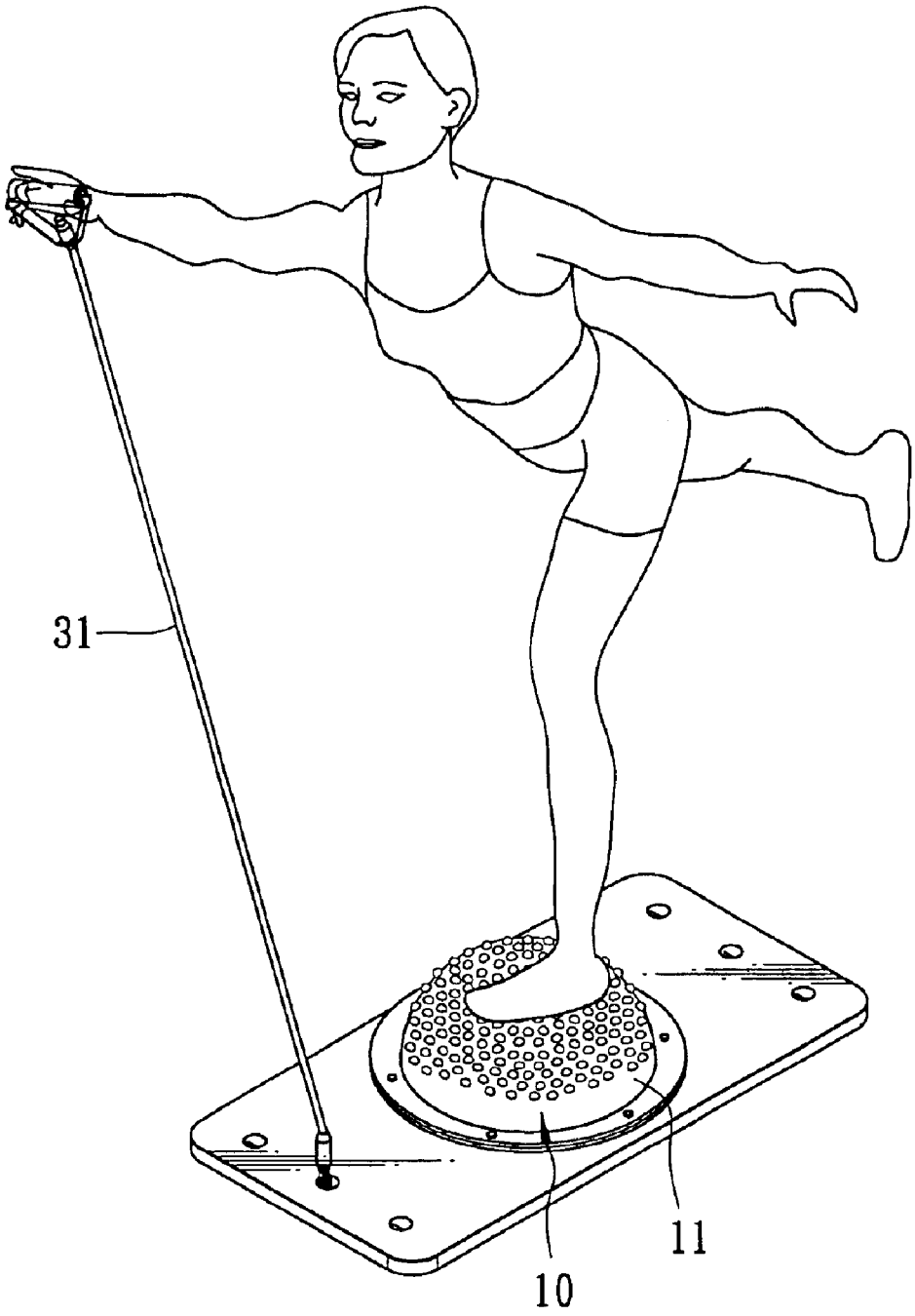

6. The exercise shown in FIG. 10 is substantially similar to the exercise shown in FIG. 9. However, in this exercise, one long holding member 31 is required. The user stands on the first curved wall 11 of the ball body 10 using one foot, and grasps the long holding member 31 with one hand to effect the single foot balance training and stretching exercise.

Figure 11:
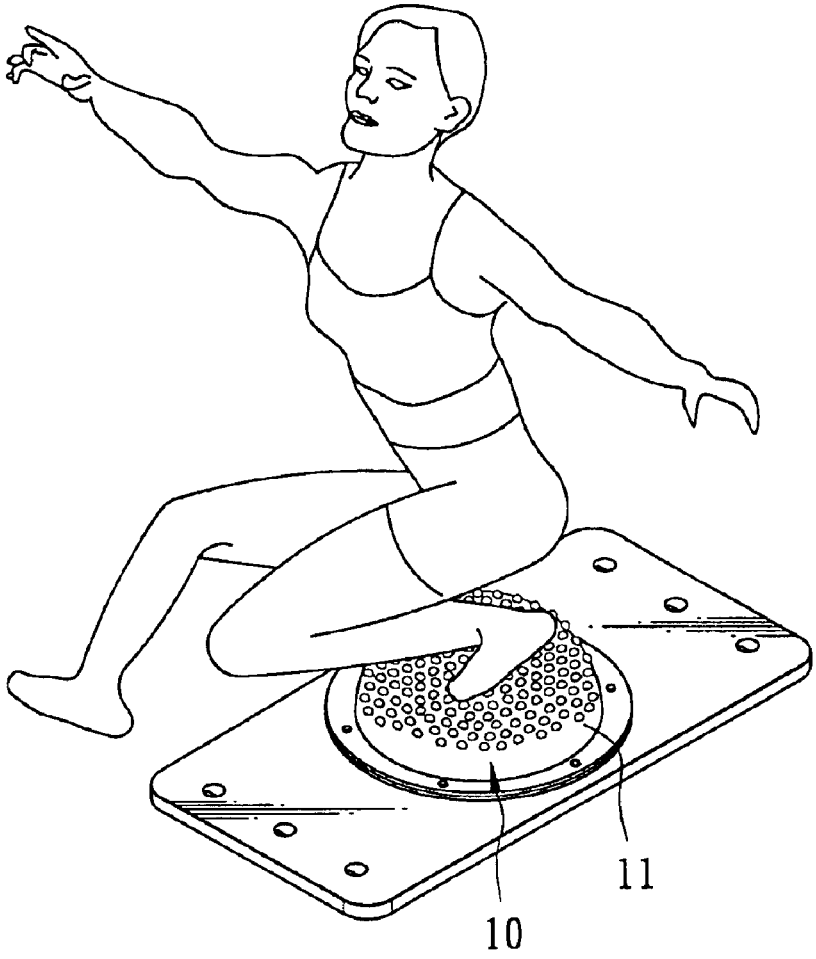

7. Referring to FIG. 11, the user half-squats on the first curved wall 11 of the ball body 10 using a single foot to proceed with the training of the leg muscles and balancing.

Figure 12:
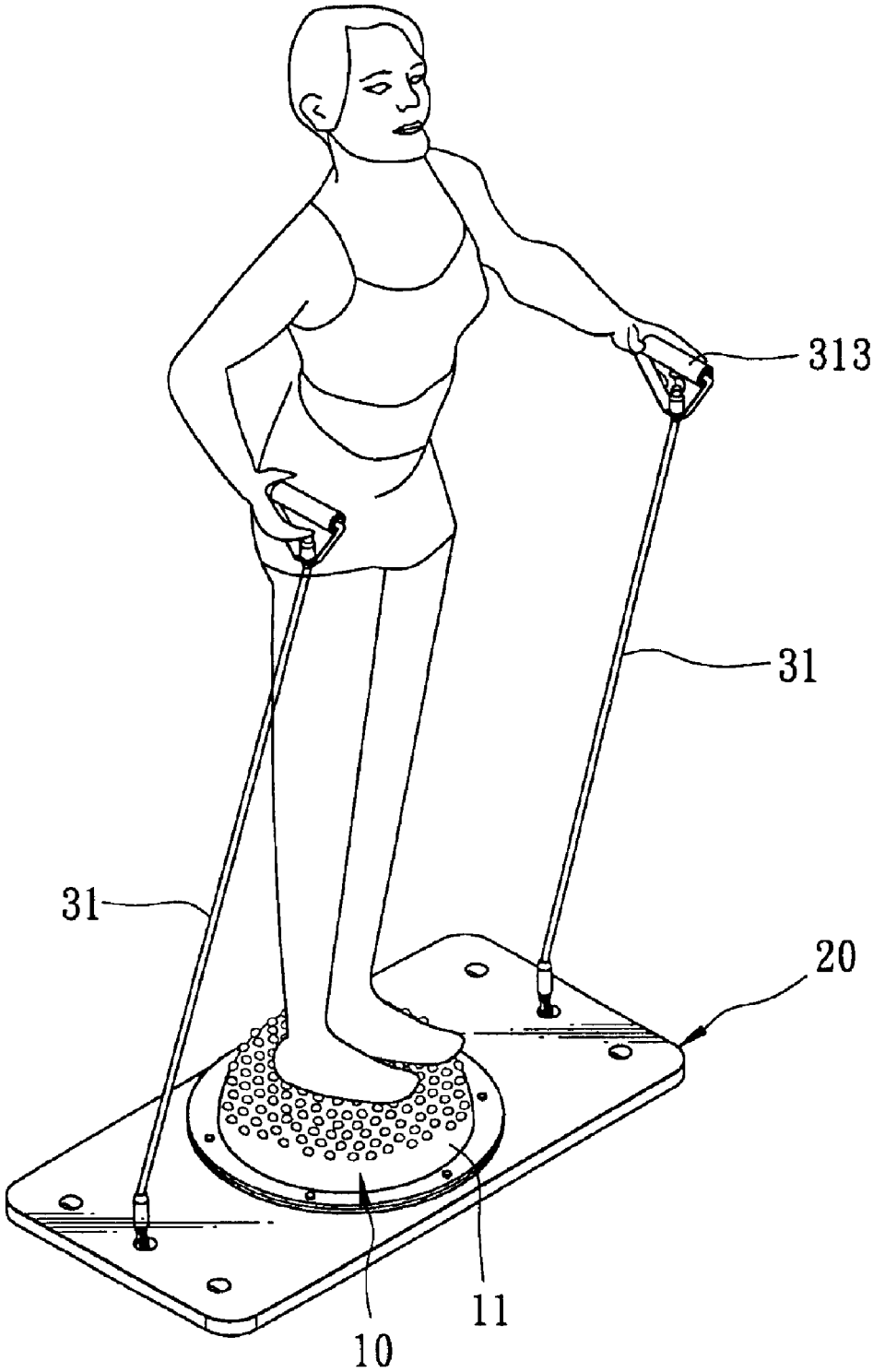

8. Referring to FIG. 12, after the long holding members 31 are fastened to middle ones of the positioning rails 241 (see FIG. 3) on two ends of the hard board 20, the user stands on the first curved wall 11 of the ball body 10 with both hands grasping the respective handgrips 313. At this time, balancing and waist twisting exercise can be performed. Furthermore, the long holding members 31 can be fastened respectively on another two positioning rails 241 (see FIG. 3) on two ends of the hard board 20 to perform greater stretching of the user's body during exercise.

Figure 13:
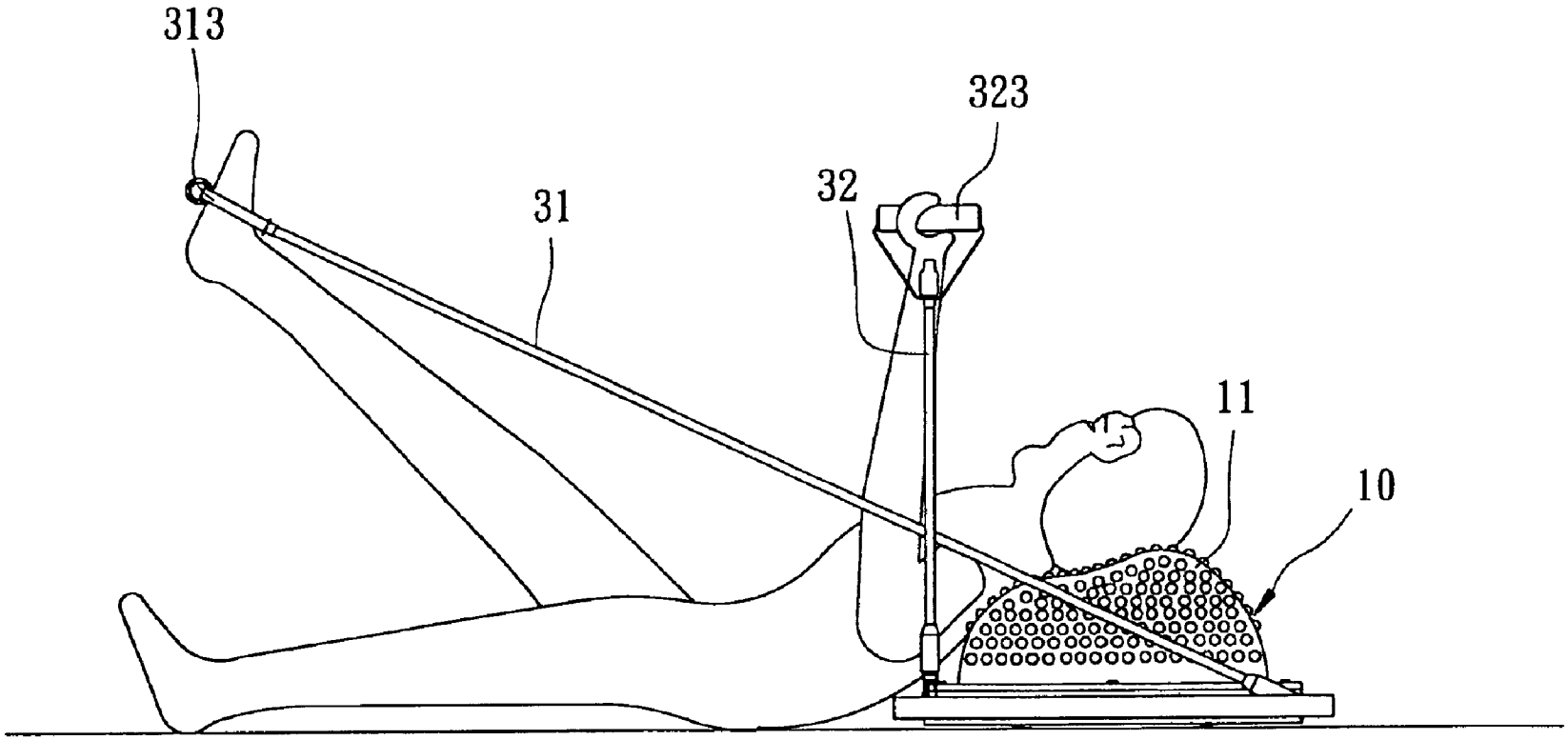

9. Referring to FIG. 13, the long and short holding members 31, 32 are required. When the user lies down on the ground with his head supported by the first curved wall 11 of the ball body 10, with his hands grasping the handgrips 323 of the short holding members 32 (only one is visible), and with one foot pushing against the handgrip 313 of one of the long holding members 31, training of the forearms and leg muscles can be achieved.

Figure 14:
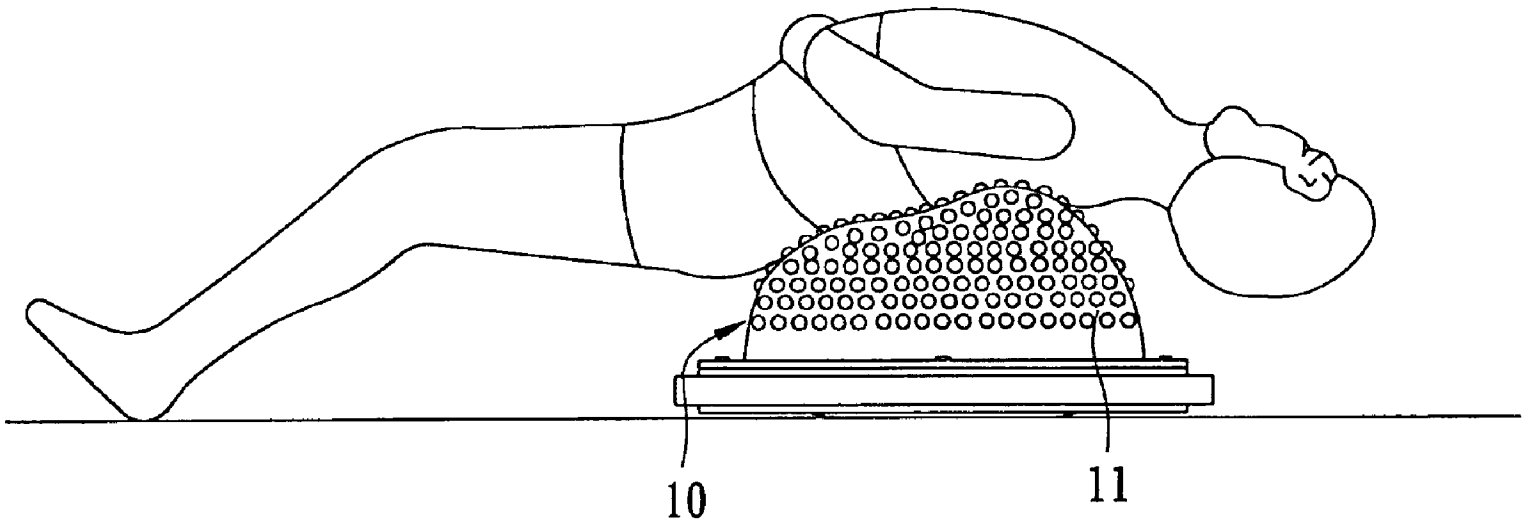

10. Referring to FIG. 14, when the user's back and waist portions recline on the first curved wall 11 of the ball body 10, stretching and training of the stomach muscles can be attained.

Figure 15:
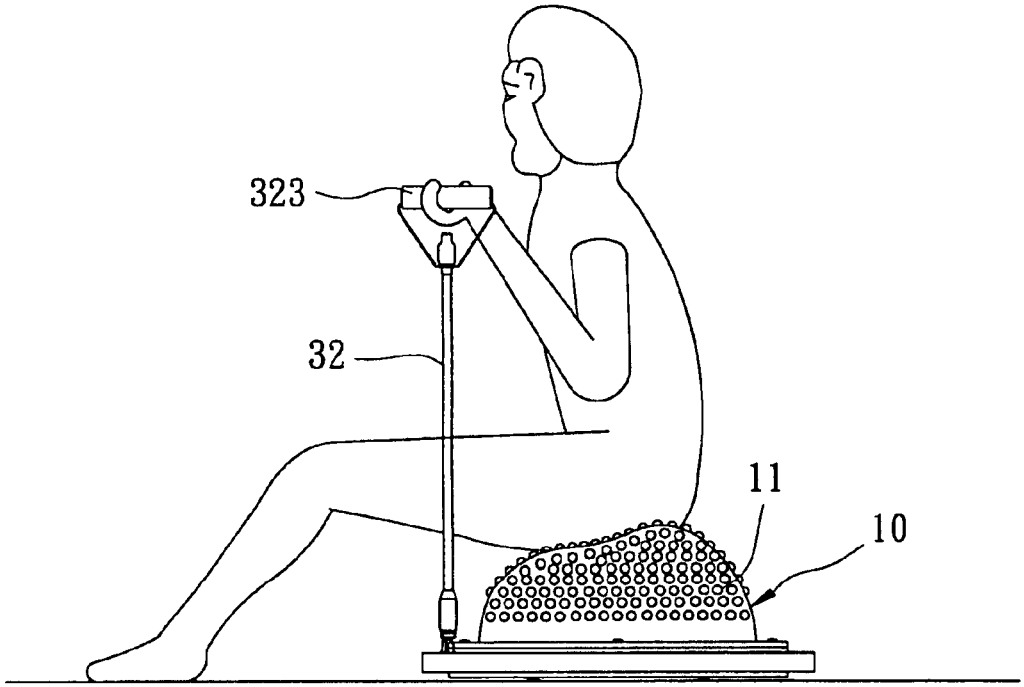

11. Referring to FIG. 15, when the user sits on the first curved wall 11 of the ball body 10 with both hands pushing upwardly the handgrips 323 of the short holding members 32 and with both feet touching the ground, training of the forearm muscles can be attained.

Figure 16:
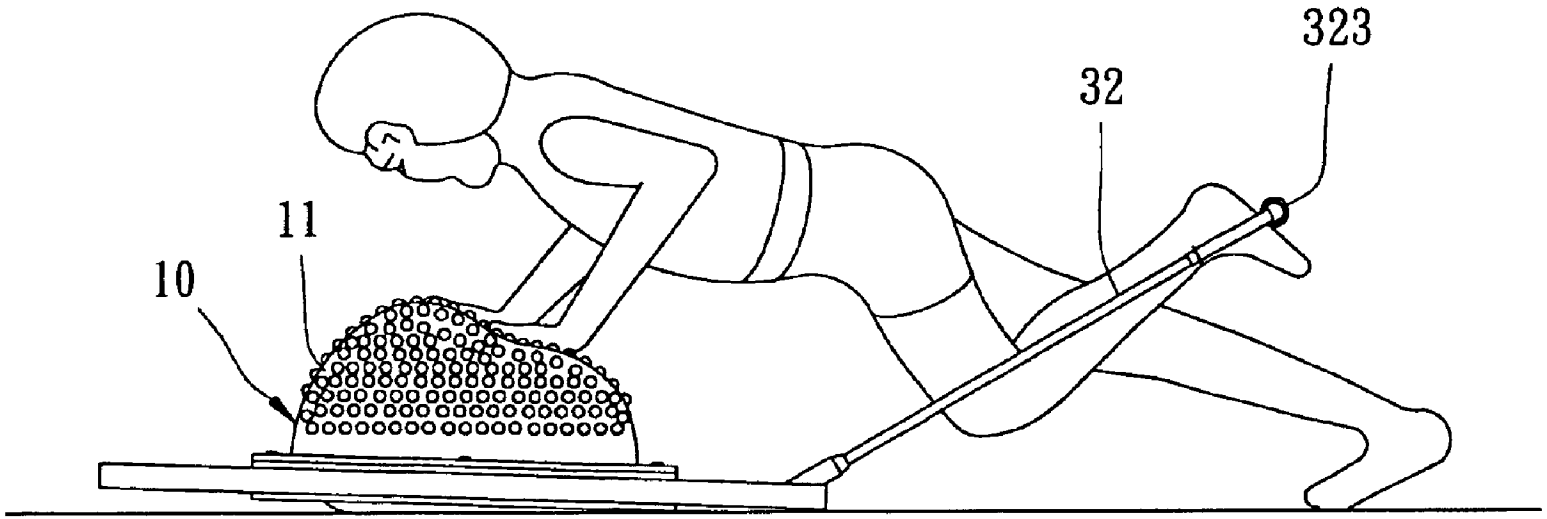

12. In the exercise shown in FIG. 16, only one short holding member 32 is required. The user has both hands pressing against the first curved wall 11 of the ball body 10, and one foot of the user pushes against the handgrip 323 of the short holding member 32. As such, training of the hip and leg muscles can be attained.

Figure 17:
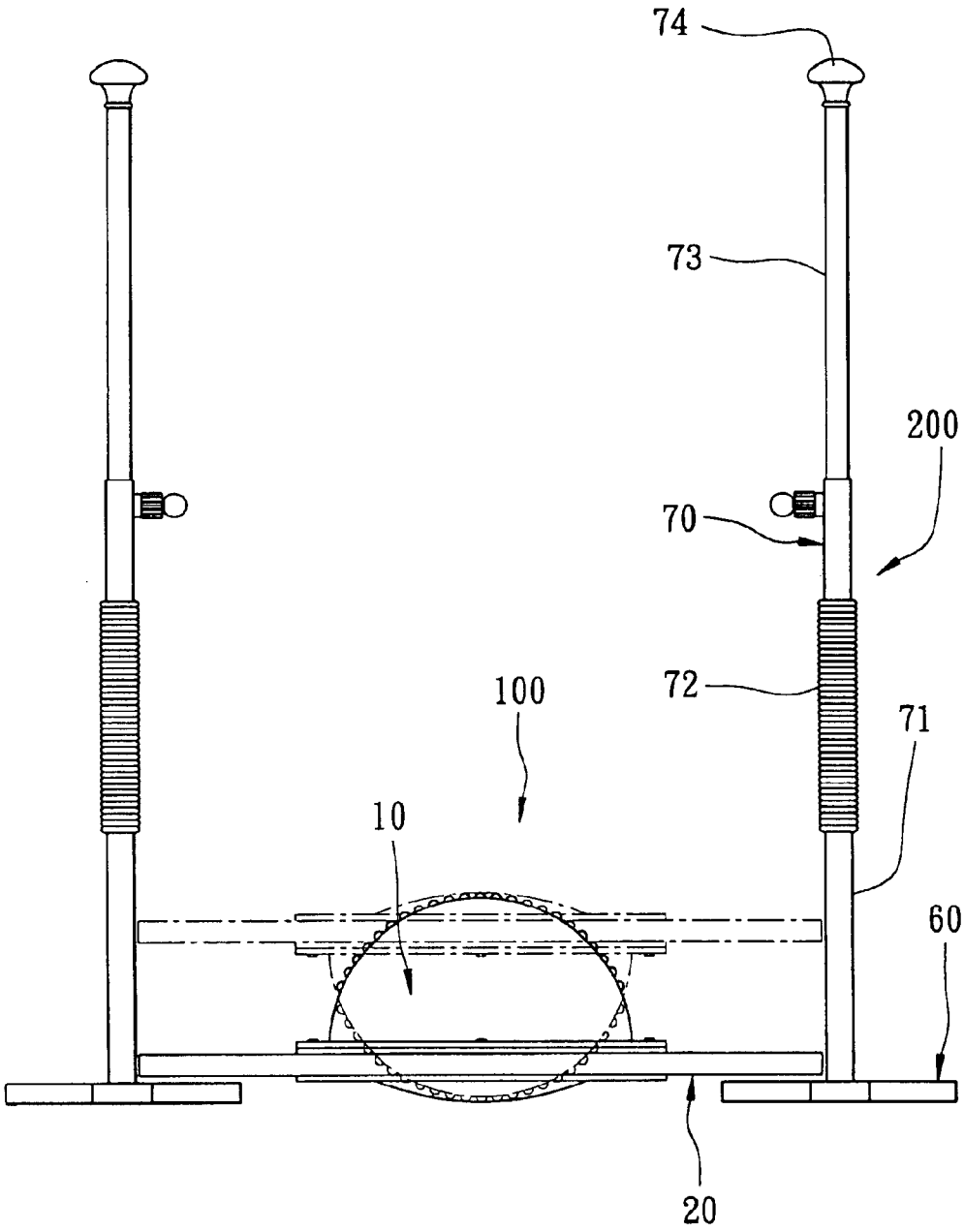
FIG. 17 is a schematic view of the second preferred embodiment of an exercise balance trainer according to the present invention.

Referring to FIG. 17, the second preferred embodiment of an exercise balance trainer according to the present invention is shown to be substantially similar to the first preferred embodiment. In this embodiment, the exercise balance trainer further comprises an upright support member 200 disposed adjacent to the assembly 100 of the hard board 20 and the ball body 10. The support member 200 includes two base seats 60 flanking the assembly 100 and adapted to be mounted on a ground surface, and two exercising rod units 70, each of which has a rigid lower rod portion 71 connected fixedly to the respective one of the base seats 60, a rigid upper rod portion 73 opposite to the lower rod portion 71, and a spring unit 72 connected between the upper and lower rod portions 73, 71 so that the upper rod portion 73 is twistable relative to the lower rod portion 71. The spring unit 72 has a hollow tubular shape, and is made of spiral spring, fiberglass, or rubber materials, so as to permit 360° rotation of the upper rod portion 73 relative to the lower rod portion 71. Each of the exercising rod units 70 includes a rotatable knob 74 connected rotatably to a top end of the upper rod portion 73.

Figure 18:
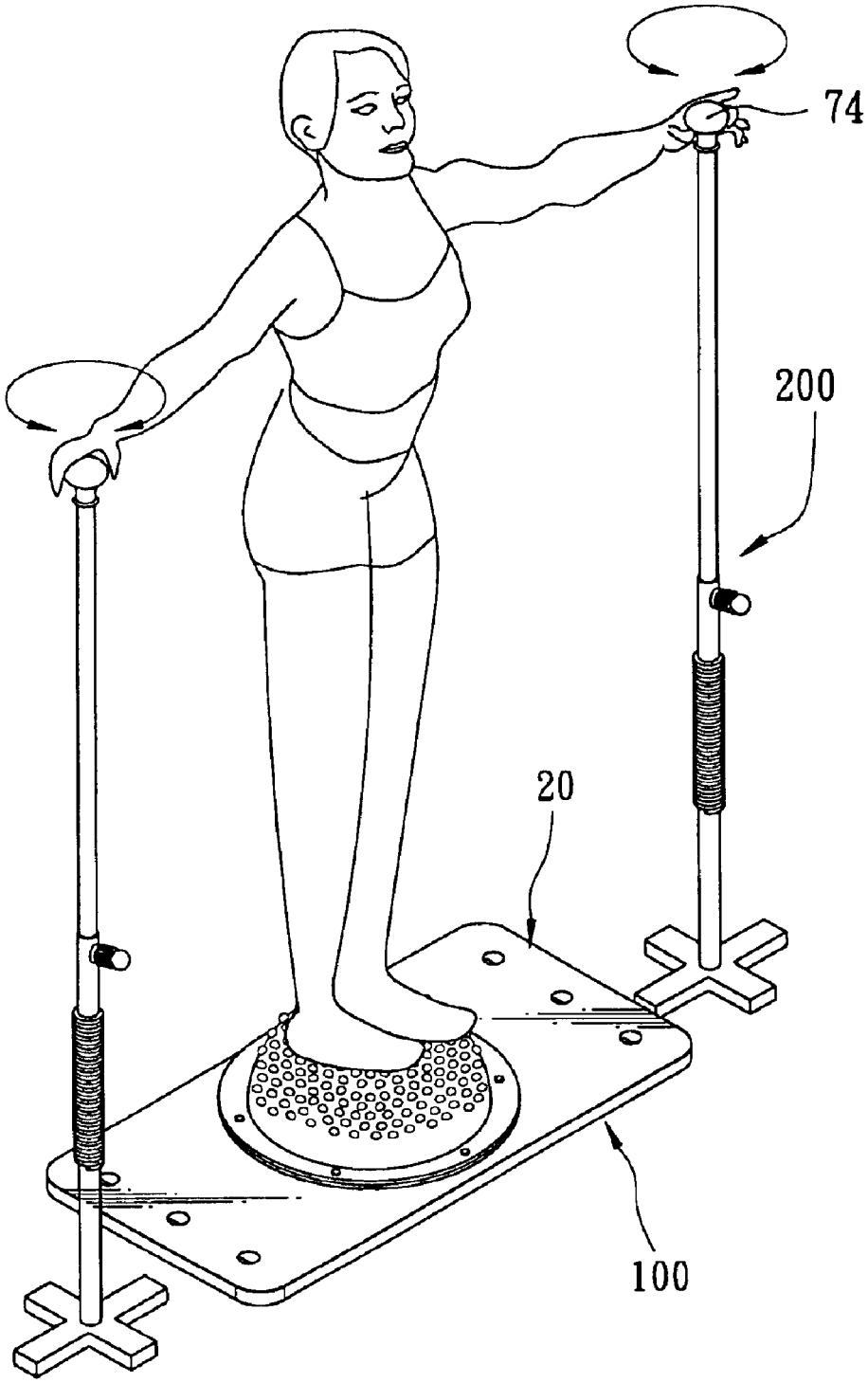
FIG. 18 is a perspective view of the second preferred embodiment in a state of use.

Referring to FIG. 18, when the user stands on the assembly 100 with his hands gripping the respective knobs 74, due to the flexible motion of the support member 200, training of the forearm and wrist muscles, and balance training can be attained.

From the above description of the first and second preferred embodiments of the exercise balance trainer of the present invention, it is evident that the object of this invention can be achieved.

While the present invention has been described in connection with what is considered the most practical and preferred embodiments, it is understood that this invention is not limited to the disclosed embodiments but is intended to cover various arrangements included within the spirit and scope of the broadest interpretation so as to encompass all such modifications and equivalent arrangements.

I claim:

1. An exercise balance trainer comprising:

a hard board having a planar first surface, a planar second surface opposite to said first surface, and a central opening extending through said hard board;

a resilient ball body connected to said hard board, said ball body having a first curved wall with a first rim, a second curved wall with a second rim connected fixedly to said first rim so as to define an air-receiving chamber between said first and second curved walls, and an annular flange connected to said board and a junction of said first and second rims, said first curved wall projecting from said first surface of said board, said second curved wall projecting from said second surface of said board, said first and second rims having the same diameter, said first curved wall having a maximum height that is not greater than one-half of said diameter of said first rim, said second curved wall having a maximum height that is not greater than one-third of said diameter of said second rim; and an annular first clamping plate sleeved on said first curved wall, and an annular second clamping plate sleeved on said second curved wall, said first and second clamping plates being interconnected threadedly so as to clamp said board and said flange therebetween.

2. The exercise balance trainer of claim 1, wherein said hard board further has an annular edge face that confines said opening said edge face being tapered and abutting against said second curved wall in such a manner that said board is sleeved on said second curved wall.

3. The exercise balance trainer of claim 2, wherein said opening has a first end in said first surface of said board, a second end in said second surface of said board, and a diameter that increases from said second end to said first end.

4. The exercise balance trainer of claim 1, wherein said first curved wall of said ball body has an outer surface formed with a plurality of rounded projections.

5. The exercise balance trainer of claim 1, further comprising an auxiliary holding unit connected detachably to said hard board.

6. The exercise balance trainer of claim 5, wherein said auxiliary holding unit includes two long holding members and two short holding members that are shorter than said long holding members, said long and short holding members being flexible and being fastened detachably to said board.

7. The exercise balance trainer of claim 6, wherein said hard board is elongated and has two ends formed with a plurality of through holes, each of which is provided with a positioning rail disposed fixedly therein, each of said long and short holding members having a connecting end provided with a snap fastener that is sleeved on a respective one of said positioning rails so as to retain said long and short holding members on said hard board.

8. The exercise balance trainer of claim 1, further comprising an upright support member disposed adjacent to an assembly of said hard board and said ball body, said support member including two base seats flanking the assembly of said hard board and said ball body and adapted to be mounted on a ground surface, and two exercising rod units, each of which has a rigid lower rod portion connected fixedly to a respective one of said base seats, a rigid upper rod portion opposite to said lower rod portion, and a spring unit connected between said upper and lower rod portions so that said upper rod portion is twistable relative to said lower rod portion.

9. The exercise balance trainer of claim 8, wherein each of said exercising rod units includes a rotatable knob connected rotatably on a top end of said upper rod portion.

* * * * *